US006540846B2

(12) United States Patent
Kashima et al.

(10) Patent No.: US 6,540,846 B2
(45) Date of Patent: Apr. 1, 2003

(54) HIGH-STRENGTH HOT-ROLLED STEEL SHEET SUPERIOR IN STRETCH-FLANGING PERFORMANCE AND FATIGUE RESISTANCE AND METHOD FOR PRODUCTION THEREOF

(75) Inventors: Takahiro Kashima, Kakogawa (JP); Shunichi Hashimoto, Kakogawa (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 18 days.

(21) Appl. No.: 09/793,579

(22) Filed: Feb. 27, 2001

(65) Prior Publication Data

US 2002/0162613 A1 Nov. 7, 2002

(51) Int. Cl.[7] ..... C22C 38/12; C22C 38/14

(52) U.S. Cl. ..... 148/320; 148/654; 148/602; 420/126; 420/127

(58) Field of Search ..... 148/320, 602, 148/654; 420/126, 127, 128

(56) References Cited

U.S. PATENT DOCUMENTS 4,802,918 A * 2/1989 Ooki et al.
5,716,464 A * 2/1998 Bano et al. ..... 148/320
5,989,366 A * 11/1999 Hayashi et al. ..... 148/505
6,162,389 A * 12/2000 Hase et al. ..... 420/92

FOREIGN PATENT DOCUMENTS

| | | | |
|---|---|---|---|
| JP | 6-172924 | 6/1994 | |
| JP | 7-11382 | 1/1995 | |
| JP | 7-70696 | 3/1995 | |
| JP | 11-036040 A * | 2/1999 | ..... C22C/38/00 |

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

Disclosed herein is a high-strength hot-rolled steel sheet superior in stretch-flanging properties and fatigue properties which comprises (in mass %) 0.01–0.10% C, less than 2% Si (including 0%), 0.5–2% Mn, less than 0.08% P (including 0%), less than 0.01% S (including 0%), less than 0.01% N (including 0%), 0.01–0.1% Al, and at least one of 0.1–0.5% Ti and less than 0.8% Nb (including 0%), with the granular bainitic structure accounting for more than 80% (by area) in its sectional metallographic structure. Disclosed also herein is a process for producing said steel sheet.

13 Claims, 1 Drawing Sheet

HIGH-STRENGTH HOT-ROLLED STEEL SHEET SUPERIOR IN STRETCH-FLANGING PERFORMANCE AND FATIGUE RESISTANCE AND METHOD FOR PRODUCTION THEREOF

BACKGROUND OF THE INVENTION

1. Field of the Invention

The present invention relates to a high-strength hot-rolled steel sheet superior in stretch-flanging performance and fatigue resistance and a method for production thereof. Owing to its good workability and fatigue resistance, this hot-rolled steel sheet finds use as a raw material for automotive parts such as chassis and suspension systems (including arms and members).

2. Description of the Related Art

The high-strength steel sheet used as a raw material of automotive parts usually has a metallographic structure of dual phase. A dual phase steel sheet, which is composed of a ferrite phase and a martensite phase dispersed therein, is renowned for its good fatigue resistance. There has recently been proposed a way of improving fatigue resistance by introduction of retained austenite into the metallographic structure. Unfortunately, the dual phase steel sheet and retained austenite steel sheet are good in fatigue resistance but poor in stretch-flanging performance and hence are difficult to work.

Any steel sheet used for automotive suspension parts is required to have high strength and good fatigue resistance after it has been made into finished products. Moreover, it needs good workability to facilitate complex forming. Particularly, it needs good stretch-flanging performance (hole expanding performance). However, the above-mentioned dual phase steel sheet and retained austenite steel sheet do not meet these requirements. In other words, there has been no steel sheet which has high strength and meets requirements for both stretch-flanging performance and fatigue properties.

With the foregoing in mind, the present inventors have been investigating the improvement of hot-rolled steel sheet in strength and stretch-flanging performance. They proposed a method for improvement in Japanese Patent Laid-open Nos. 172924/1994, 11382/19995, and 70696/1995 based on the results of their investigation on the chemical composition and metallographic structure of low-carbon steels.

Although their investigation achieved improvement in strength and stretch-flanging performance to some extent, it is still difficult to improve both of them simultaneously because they are contradictory to each other. In addition, a steel product to be used for automotive parts (as in the present invention) needs good workability (as typified by stretch-flanging performance) as well as good fatigue resistance for safety. There is plenty of room for further improvement, particularly in stretch-flanging performance.

OBJECT AND SUMMARY OF THE INVENTION

The present invention was completed in view of the above-mentioned situation. It is an object of the present invention to provide a hot-rolled steel sheet having high strength as well as good workability, particularly good stretch-flanging performance. It is another object of the present invention to provide a hot-rolled steel sheet having good fatigue resistance.

DESCRIPTION OF THE PREFERRED EMBODIMENTS

Figure 1:
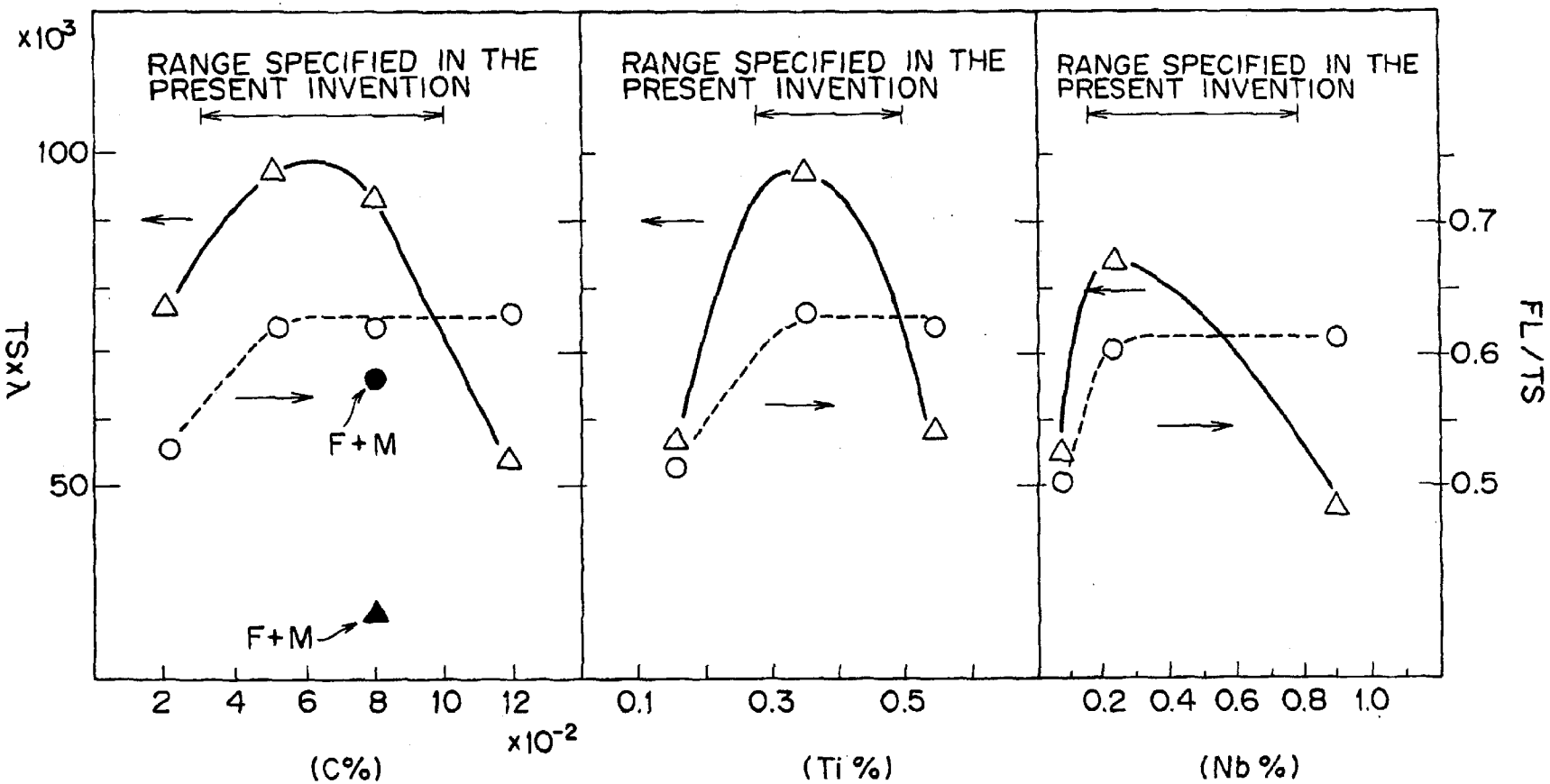
FIG. 1 is a graph showing how each content of C, Ti, and Nb affects TS×λ and fatigue limit/TS of the steel product obtained in Example.

According to the present invention, the above-mentioned problems are solved by a hot-rolled steel sheet which comprises (in mass %) 0.01–0.10% C, less than 2% Si (including 0%), 0.5–2% Mn, less than 0.08% P (including 0%), less than 0.01% S (including 0%), less than 0.01% N (including 0%), 0.01–0.1% Al, and at least one of 0.1–0.5% Ti and less than 0.8% Nb (including 0%), wherein a granular bainitic structure accounts for more than 80% (by area) in a sectional metallographic structure of the steel sheet.

The hot-rolled steel sheet of the present invention is produced by heating a steel having the above-mentioned composition at 1150° C. or above, hot-rolling the heated steel at a finishing temperature of 700° C. or above, cooling the rolled steel sheet to 500° C. or below at an average cooling rate of 50° C./sec or above, and winding the cooled steel sheet at 500° C. or below.

The hot-rolled steel sheet of the present invention may further contain at least one of 0.26–0.50% Ti and less than 0.8% Nb (including 0%).

The hot-rolled steel sheet of the present invention should preferably have a cleanliness lower than 0.050% for $C_2$ inclusions.

In an attempt to develop a hot-rolled steel sheet meeting all of the above-mentioned requirements, the present inventors carried out a series of researches which led to the finding that a hot-rolled steel sheet has high strength, good fatigue resistance, and good stretch-flanging performance if it is formed from a low-carbon steel in such a way that its metallographic structure is dominated by granular bainitic ferrite. This finding has provided a basis for the present invention.

It was also found that the hot-rolled steel sheet has a greatly improved stretch-flanging performance if it is composed mainly of granular bainitic ferrite structure and has an adequately controlled cleanliness for $C_2$ inclusions. This finding has provided another basis for the present invention.

The following are grounds for establishing the chemical composition and metallographic structure of the steel and the conditions of heat treatment of the steel.

The steel should have the above-mentioned chemical composition for reasons given below.

C: 0.03–0.1%

C is an essential element to improve strength. In addition, upon slab heating, C increases the amount of C as a solute as well as the amount of Ti and Nb as a solute in the steel, thereby forming the granular bainitic ferrite structure during cooling that follows hot-rolling. In order for C to produce these effects, it is necessary that the steel contain more than 0.03% C, preferably more than 0.04% C. C in an excess amount tends to form martensitic structure or M/A constituent (which is detrimental to stretch-flanging performance) in the cooling process that follows hot-rolling. Therefore, an adequate C content should be less than 0.1%, preferably less than 0.08%.

Si: less than 2% (including 0%)

Si is an element to effectively increase strength without deteriorating the stretch-flanging performance. Si in an excess amount tends to form polygonal ferrite, thereby preventing the formation of granular bainitic ferrite structure and aggravating the stretch-flanging performance. Moreover, Si in an excess amount increases resistance to hot deformation of steel sheet, making welded parts brittle. Also Si in an excess amount adversely affects the surface state of steel sheet. Therefore, an adequate Si content should be less than 2%, preferably less than 1%.

Mn: 0.5–2%

Mn functions as a solid-solution strengthening element; it also promotes transformation, thereby promoting the formation of granular bainitic ferrite structure. A content necessary for Mn to produce its effect is more than 0.5%, preferably more than 0.7%. However, Mn in an excess amount makes the steel sheet excessively sensitive to hardenability, thereby forming a large amount of low-temperature transformation products. Thus, the resulting steel sheet is poor in stretch-flanging performance. Therefore, an adequate Mn content should be less than 2%, preferably less than 1.8%.

P: less than 0.08% (including 0%)

P is an element to perform solid-solution strengthening without deteriorating ductility (workability). However, P in an excess amount causes crack-induced deformation due to its segregation. Therefore, an adequate P content should be less than 0.08%, preferably less than 0.06%.

Al: 0.01–0.1%

Al is added as a deoxidizer at the time of steel making. Through its oxidizing action, Al reduces the amount of oxide inclusions; however, Al in an excess amount makes itself oxide inclusions, thereby deteriorating workability. An adequate Al content should be established in consideration of Al's merits and demerits. It is usually 0.01–0.1%, preferably 0.02–0.08%.

S: less than 0.01% (including 0%)

S is a deleterious element to combine with Mn in the steel, thereby forming inclusions, such as MnS, which adversely affect the stretch-flanging performance. An adequate S content to substantially prevent such detrimental effects is less than 0.01%, preferably less than 0.005%.

N: less than 0.01% (including 0%)

N combines with Al and Ti present in the steel, thereby forming nitrides (such as AlN and TiN) as hard inclusions, which have a marked adverse effect on the stretch-flanging performance and fatigue resistance. An adequate N content should be less than 0.01%, preferably less than 0.006%.

Incidentally, the N content increases if the S content is extremely reduced by desulfurization ascribed to the steel-making facility. The thus formed N reacts with Ti to form TiN which is detrimental to the stretch-flanging performance. In order to achieve both objects—preventing the formation of $C_2$ inclusions due to increase in the N content and ensuring the good stretch-flanging performance by keeping the S content low, not only is it necessary to specify the N content and S content separately but it is also necessary to control both of them from the comprehensive standpoint.

Ti: 0.26–0.50% and/or Nb: 0.15–0.8%

Ti and Nb dissolve in steel when the slab is heated to about 1115° C. or above prior to hot rolling. At the time of quenching after hot rolling, Ti or Nb as a solute prevents the nucleation of polygonal ferrite and promotes the formation of granular bainitic ferrite structure with a high dislocation density. For their appropriate action, the steel should contain more than 0.26% Ti, preferably more than 0.28% Ti, and/or more than 0.15% Nb, preferably more than 0.20% Nb. The steel containing more than 0.50% Ti or more than 0.8% Nb tends to leave intact the metallographic structure resulting from hot working. In other words, the steel does not have an adequate metallographic structure. Moreover, excessive Ti and Nb form a large amount of $C_2$ inclusions (such as TiN) which adversely affect the stretch-flanging performance. A preferable Ti content is less than 0.45% and a preferable Nb content is less than 0.6%.

According to the present invention, the steel sheet should contain essential elements as mentioned above, with the remainder being Fe and inevitable impurities. The steel sheet may optionally contain in an adequate amount at least one element selected from the group consisting of Mo, Cr, Cu, Ni, B, and Ca so that it is modified as follows.

Cu: This element contributes to solid-solution strengthening, thereby increasing strength, and promotes the formation of granular bainitic ferrite structure, thereby improving the stretch-flanging performance. An adequate Cu content is less than 0.5%. Cu exceeding this limit produces no additional effect but becomes wasted. Moreover, excessive Cu causes surface defects (such as sliver) in the hot rolling process.

Ni: This element prevents surface defects due to Cu from occurring at the time of hot working. In the case where the steel sheet contains Cu, it is desirable to add Ni in an amount less than 0.5% (which is approximately equal to the Cu content) so as to avoid surface defects which would otherwise occur during hot rolling.

Mo and Cr: These elements contribute to solid-solution strengthening and promote transformation, thereby promoting the formation of granular bainitic ferrite structure. They produce their effect when they are contained in a trace amount. Their content should be less than 0.5%. If present in an excess amount, they give rise to a large amount of low-temperature transformation products (such as martensite and M/A constituent) which adversely affect the stretch-flanging performance.

B: This element enhances hardenability and effectively forms granular bainitic ferrite. An adequate B content should be less than 0.005%, preferably less than 0.003%. B exceeding this limit produces no additional effect but becomes wasted.

Ca: This element combines with S in the steel, thereby forming a spherical sulfide (CaS) which is harmless to the stretch-flanging performance. Therefore, it prevents the formation of MnS harmful to hole expansion. An adequate Ca content is less than about 0.01%. Ca exceeding this limit produces no additional effect but becomes wasted.

The above-mentioned granular bainitic ferrite structure looks acicular when observed under an optical microscope or SEM. For accurate judgment, it is necessary to identify the substructure by TEM observation. The granular bainitic ferrite has no lath structure but has the substructure with a high dislocation density. It apparently differs from the bainite structure in not possessing carbides in the structure. It also differs from polygonal ferrite or quasi-polygonal ferrite, the former having a substructure with no or very low dislocation density, the latter having a substructure of fine sub-grains.

The following explains the process for producing the steel which has the above-mentioned chemical composition and metallographic structure.

The working of the present invention is accomplished by preparing a steel having the above-mentioned chemical composition, making the steel into a slab in the usual way, and subjecting the slab to hot rolling. Prior to hot rolling, the slab should be heated to 1150° C. This heating is necessary for C, Ti, and Nb to dissolve in the steel, because TiC and NbC begin to dissolve in austenite at 1150° C. These elements in the solid solution prevent the formation of polygonal ferrite structure but promote the formation of granular bainitic ferrite structure during cooling that follows hot rolling.

The hot rolling should be carried out at a finishing temperature higher than 700° C. Cooling from this high temperature (γ region) gives rise to a structure composed mainly of granular bainitic ferrite. If the finishing temperature is lower than 700° C., there exist two phases during hot rolling and the resulting hot-rolled steel sheet has a structure containing a reformed ferrite structure and hence is poor in stretch-flanging performance and fatigue strength. The hot rolling should be followed by cooling at an average cooling rate greater than 50° C./sec. Slower cooling than specified above does not prevent the polygonal ferrite transformation and hence does not yield the steel sheet having the structure (with a certain area of granular bainitic ferrite) specified in the present invention. In addition, cooling to ensure the specified area of granular bainitic ferrite structure should be carried out such that the cooling rate does not fluctuate more than ±20° C./sec throughput the cooling process except for 10% of time immediately after hot rolling and 10% of time immediately before winding in the interval between hot rolling and winding.

Winding should be carried out at a temperature lower than 500° C. Winding at a higher temperature than this gives rise to the polygonal ferrite structure which leads to low fatigue strength. Winding at 300–500° C. causes TiC and NbC to precipitate even if they are present in a trace amount, and they produce the effect of pinning dislocation in the granular bainitic ferrite structure under repeated stress. This contributes to fatigue properties. Therefore, it is desirable to carry out winding at 300–500° C.

A detailed description is given below of the effect of metallographic structure and inclusions. The steel sheet of the present invention should have a high degree of cleanliness (with inclusions therein reduced) so that it forms no voids during stretch-flanging. Of inclusions, sulfides and nitrides have a marked adverse effect on the stretch-flanging performance. Therefore, the content of $C_2$ inclusion in the steel sheet should not exceed 0.050%, preferably 0.040%. This object is achieved by reducing the content of N and Ti as the source of inclusions. The degree of cleanliness for $C_2$ inclusions is obtained by the method of JIS G5505.

Incidentally, inclusions affect the cracking sensitivity more strongly as the phase increases in hardness. The bainite phase coexisting with the polygonal ferrite phase (low hardness) has to have a higher hardness in order to achieve high strength in a composite structure, for example, in ferrite-bainite phase as previously known. Inclusions affect the cracking sensitivity more strongly when inclusions exist in the bainite phase of high hardness. By contrast, such a situation does not arise in the case of granular bainitic ferrite structure, because the granular bainitic ferrite structure is free from the polygonal ferrite phase (which is soft) and hence it does not need a high hardness unlike the bainite phase in the above-mentioned ferrite-bainite steel. Consequently, inclusions in the granular bainitic ferrite structure exerts a weaker influence on the cracking sensitivity than inclusions in the bainite phase of ferrite-bainite steel of the same strength. Thus, the steel of granular bainitic ferrite structure is hardly subject to cracking. It is very important in the present invention that the steel sheet has a specific structure (or granular bainitic ferrite structure) and also has an adequately controlled cleanliness for inclusions.

For the steel sheet of the present invention to have both high fatigue strength and good stretch-flanging performance, it should have a metallographic structure dominated by the granular bainitic ferrite structure which accounts for more than 80% (by area), preferably more than 90% (by area), more preferably nearly 100% (by area) of the entire metallographic structure. However, the metallographic structure may contain a small amount of polygonal ferrite structure and lath-like bainitic ferrite structure which might occur under some cooling conditions. The object of the present invention is achieved so long as their area is less than 20%, preferably less than 10%.

EXAMPLES

The following examples are included merely to aid in the understanding of the invention, and variations may be made by one skilled in the art without departing from the spirit and scope of the invention.

Example 1

Samples of steel slabs having the chemical composition shown in Table 1 were prepared. Each slab was heated at 1000–1150° C. for 30 minutes. The heated slab was hot-rolled into a 2.5-mm sheet in the usual way (at a finishing temperature of 780° C.). The rolled sheet was cooled at an average cooling rate of 40–100° C./sec. The cooled sheet was wound up at 200–600° C. The wound sheet was cooled in a furnace. Details of rolling conditions are given in Table 2.

The thus obtained hot-rolled steel sheets underwent tensile test and hole expansion test with specimens conforming to JIS No. 5 (in the rolling direction). The specimens were also examined for structure by SEM and TEM observation. The results are shown in Table 3.

The hole expansion test consists of punching a hole (10 mm in diameter) in the specimen and forcing a conical punch (60°) into the hole. When the specimen cracks across its thickness, the diameter (d) of the expanded hole is measured. The result is expressed in terms of the ratio (λ) of hole expansion calculated from the following formula.

$$\lambda=[(d-d_0)/10]\times 100(\%),$$

where $d_0$=10 mm

For structure examination, the specimen was observed in five fields (×3000) under TEM. Those specimens having the granular bainitic ferrite structure of high dislocation density are indicated by "g.B.F" (together with its areal ratio) in Table 3. This structure contains a small amount of additional fine polygonal ferrite structure and lath-like bainitic ferrite structure.

TABLE 1

(Chemical composition of steel)

| No. | C | Si | Mn | P | S | Al | N | Ti | Nb | Others |
|---|---|---|---|---|---|---|---|---|---|---|
| 1 | 0.02 | 0.4 | 1.4 | 0.013 | 0.002 | 0.037 | 0.0037 | 0.38 | — | |
| 2 | 0.05 | 0.5 | 1.5 | 0.015 | 0.002 | 0.035 | 0.0038 | 0.35 | — | |
| 3 | 0.08 | 0.5 | 1.5 | 0.014 | 0.002 | 0.038 | 0.0039 | 0.36 | — | |
| 4 | 0.12 | 4.0 | 1.5 | 0.015 | 0.001 | 0.035 | 0.0038 | 0.37 | — | |
| 5 | 0.05 | 0.5 | 1.6 | 0.015 | 0.002 | 0.035 | 0.0038 | 0.55 | — | |
| 6 | 0.04 | 0.5 | 1.5 | 0.016 | 0.002 | 0.037 | 0.0039 | 0.15 | — | |
| 7 | 0.05 | 0.4 | 1.6 | 0.015 | 0.002 | 0.035 | 0.0040 | — | 0.08 | |

TABLE 1-continued (Chemical composition of steel)

| No. | C | Si | Mn | P | S | Al | N | Ti | Nb | Others |
|---|---|---|---|---|---|---|---|---|---|---|
| 8 | 0.05 | 0.5 | 1.5 | 0.015 | 0.002 | 0.035 | 0.0039 | — | 0.25 | |
| 9 | 0.05 | 0.5 | 1.5 | 0.014 | 0.003 | 0.039 | 0.0038 | — | 0.9 | |
| 10 | 0.05 | 0.4 | 1.5 | 0.015 | 0.002 | 0.035 | 0.0039 | 0.35 | 0.5 | |
| 11 | 0.04 | 0.5 | 1.4 | 0.013 | 0.002 | 0.035 | 0.0038 | 0.35 | — | Mo: 0.45 |
| 12 | 0.05 | 0.5 | 1.5 | 0.015 | 0.002 | 0.038 | 0.0037 | 0.35 | — | Cr: 0.40 |
| 13 | 0.05 | 0.5 | 1.5 | 0.015 | 0.002 | 0.035 | 0.0038 | 0.34 | — | Ca: 12 ppm |
| 14 | 0.05 | 0.5 | 1.4 | 0.013 | 0.002 | 0.037 | 0.0039 | 0.35 | — | Cu: 0.45<br>Ni: 0.40 |
| 15 | 0.05 | 0.5 | 1.5 | 0.014 | 0.001 | 0.038 | 0.0041 | 0.34 | — | B: 12 ppm |
| 16 | 0.08 | 0.5 | 1.5 | 0.015 | 0.001 | 0.038 | 0.0040 | — | — | |
| 17 | 0.15 | 1.5 | 1.5 | 0.015 | 0.001 | 0.038 | 0.0041 | — | — | |
| 18 | 0.05 | 0.5 | 1.5 | 0.016 | 0.002 | 0.035 | 0.0038 | 0.35 | 0.25 | |
| 19 | 0.05 | 0.4 | 1.5 | 0.013 | 0.001 | 0.035 | 0.0025 | 0.15 | — | |
| 20 | 0.05 | 0.4 | 1.5 | 0.013 | 0.001 | 0.035 | 0.0028 | 0.20 | — | |
| 21 | 0.05 | 0.4 | 1.5 | 0.013 | 0.001 | 0.035 | 0.0029 | 0.25 | — | |

TABLE 2

Hot rolling

| Experiment No. | Steel No. | SRT | FDT | CR Av. | CR Max. | CR Min. | CT |
|---|---|---|---|---|---|---|---|
| 1 | 1 | 1250 | 853 | 94 | 110 | 80 | 450 |
| 2 | 2 | 1250 | 845 | 85 | 100 | 70 | 450 |
| 3 | 3 | 1250 | 851 | 92 | 108 | 82 | 450 |
| 4 | 4 | 1250 | 856 | 87 | 98 | 72 | 450 |
| 5 | 5 | 1250 | 848 | 91 | 102 | 81 | 450 |
| 6 | 6 | 1250 | 851 | 93 | 107 | 81 | 450 |
| 7 | 7 | 1250 | 850 | 87 | 98 | 67 | 450 |
| 8 | 8 | 1250 | 855 | 90 | 110 | 78 | 450 |
| 9 | 9 | 1250 | 848 | 88 | 95 | 80 | 450 |
| 10 | 10 | 1250 | 850 | 92 | 111 | 76 | 450 |
| 11 | 11 | 1250 | 852 | 89 | 100 | 78 | 450 |
| 12 | 12 | 1250 | 848 | 88 | 100 | 78 | 450 |
| 13 | 13 | 1250 | 851 | 91 | 102 | 75 | 450 |
| 14 | 14 | 1250 | 850 | 87 | 105 | 68 | 450 |
| 15 | 15 | 1250 | 848 | 90 | 98 | 81 | 450 |
| 16 | 2 | 1100 | 851 | 95 | 106 | 83 | 450 |
| 17 | 2 | 1200 | 850 | 85 | 99 | 70 | 450 |
| 18 | 2 | 1250 | 748 | 91 | 101 | 78 | 450 |
| 19 | 2 | 1250 | 655 | 93 | 105 | 81 | 450 |
| 20 | 2 | 1250 | 851 | 48 | 65 | 28 | 450 |
| 21 | 2 | 1250 | 853 | 75 | 88 | 59 | 450 |
| 22 | 2 | 1250 | 847 | 95 | 110 | 83 | 200 |
| 23 | 2 | 1250 | 852 | 93 | 104 | 80 | 350 |
| 24 | 2 | 1250 | 850 | 89 | 100 | 80 | 550 |
| 25 | 2 | 1250 | 849 | 90 | 103 | 78 | 650 |
| 26 | 16 | 1250 | 855 | 92 | 103 | 80 | 350 |
| 27 | 17 | 1250 | 849 | 91 | 101 | 80 | 450 |
| 28 | 18 | 1250 | 845 | 89 | 105 | 70 | 450 |
| 29 | 19 | 1250 | 850 | 30 | 37 | 20 | 400 |
| 30 | 20 | 1250 | 850 | 30 | 37 | 18 | 400 |
| 31 | 21 | 1250 | 850 | 30 | 39 | 19 | 400 |
| 32 | 19 | 1250 | 850 | 80 | 95 | 66 | 400 |
| 33 | 20 | 1250 | 850 | 80 | 96 | 64 | 400 |
| 34 | 21 | 1250 | 850 | 80 | 99 | 62 | 400 |
| 35 | 19 | 1250 | 850 | 95 | 105 | 84 | 380 |
| 36 | 20 | 1250 | 850 | 95 | 110 | 81 | 380 |
| 37 | 21 | 1250 | 850 | 95 | 108 | 83 | 380 |

SRT—Slab Reheating Temperature

FDT—Finishing Delivering Temperature

Av.—Average cooling rate in the entire period from the completion of hot rolling to the start of winding.

Max. and Min.—Maximum and minimum cooling rate, respectively, in the entire period from the completion of hot rolling to the start of winding, except for 10% each immediately after hot rolling and immediately before winding.

TABLE 3

(Characteristic properties and structure)

| Experiment No. | YS | TS | EI | λ | Fatigue limit | Fatigue limit/TS | Structure |
|---|---|---|---|---|---|---|---|
| 1 | 450 | 550 | 30 | 140 | 280 | 0.51 | pF |
| 2 | 700 | 820 | 18 | 120 | 510 | 0.62 | gBF (95%) |
| 3 | 710 | 850 | 15 | 110 | 530 | 0.62 | gBF (98%) |
| 4 | 720 | 880 | 13 | 60 | 540 | 0.63 | gBF (99%) |
| 5 | 780 | 900 | 12 | 60 | 570 | 0.63 | gBF (98%) |
| 6 | 680 | 799 | 20 | 70 | 410 | 0.51 | F + B |
| 7 | 710 | 810 | 22 | 65 | 400 | 0.50 | F + B |
| 8 | 715 | 800 | 18 | 105 | 481 | 0.60 | gBF (98%) |
| 9 | 770 | 875 | 13 | 55 | 530 | 0.61 | gBF (85%) |
| 10 | 720 | 805 | 16 | 110 | 490 | 0.61 | gBF (97%) |
| 11 | 730 | 830 | 16 | 102 | 530 | 0.64 | gBF (95%) |
| 12 | 712 | 812 | 17 | 110 | 500 | 0.62 | gBF (88%) |
| 13 | 711 | 800 | 18 | 120 | 510 | 0.64 | gBF (89%) |
| 14 | 708 | 810 | 17 | 115 | 520 | 0.64 | gBF (85%) |
| 15 | 715 | 815 | 18 | 110 | 510 | 0.64 | gBF (88%) |
| 16 | 460 | 580 | 25 | 125 | 290 | 0.50 | pF |
| 17 | 490 | 620 | 23 | 110 | 400 | 0.65 | gBF (89%) |
| 18 | 650 | 750 | 18 | 100 | 480 | 0.64 | gBF (83%) |
| 19 | 500 | 600 | 19 | 115 | 310 | 0.52 | gBF (65%) + pF |
| 20 | 450 | 560 | 22 | 123 | 280 | 0.50 | pF |
| 21 | 650 | 815 | 16 | 110 | 500 | 0.61 | gBF (88%) |
| 22 | 500 | 820 | 20 | 35 | 480 | 0.59 | gBF (75%) + M |
| 23 | 570 | 750 | 18 | 115 | 440 | 0.62 | gBF (89%) |
| 24 | 568 | 710 | 20 | 108 | 398 | 0.56 | gBF (55%) + pF |
| 25 | 370 | 610 | 23 | 105 | 310 | 0.51 | pF |
| 26 | 465 | 770 | 25 | 40 | 450 | 0.58 | F + M |
| 27 | 500 | 750 | 30 | 35 | 460 | 0.61 | F + B + resid. γ |
| 28 | 717 | 824 | 19 | 120 | 503 | 0.61 | gBF (97%) |
| 29 | 540 | 700 | 21 | 108 | 378 | 0.54 | gBF (65%) |
| 30 | 495 | 685 | 19 | 110 | 349 | 0.51 | gBF (70%) |
| 31 | 502 | 695 | 20 | 105 | 389 | 0.56 | gBF (75%) |
| 32 | 710 | 815 | 17 | 125 | 473 | 0.58 | gBF (88%) |
| 33 | 708 | 820 | 16 | 132 | 484 | 0.59 | gBF (85%) |
| 34 | 705 | 810 | 16 | 138 | 470 | 0.58 | gBF (84%) |
| 35 | 700 | 800 | 15 | 135 | 456 | 0.57 | gBF (98%) |
| 36 | 690 | 795 | 16 | 141 | 445 | 0.56 | gBF (99%) |
| 37 | 695 | 790 | 17 | 138 | 450 | 0.57 | gBF (97%) |

The results in Tables 1 to 3 suggest the following. The specimens in experiment Nos. 2, 3, 8, 10–15, 17, 18, 21, 23, and 32–37 have good stretch-flanging performance and fatigue properties as indicated by the adequate values of tensile strength (TS), yield strength (YS), hole expansion ratio (λ value), and fatigue limit which meet the requirements of the present invention.

By contrast, the specimens for comparison in experiments other than mentioned above failed to meet at least one of the requirements for strength, hole expansion ratio, and fatigue limit, as explained below.

Experiment No. 1: The steel has an insufficient carbon content and a metallographic structure consisting mainly of polygonal ferrite. Therefore, the specimen is poor in fatigue properties, with low strength and fatigue limit.

Experiment No. 4: The steel contains carbon more than specified, so that the specimen has a low λ value and is poor in stretch-flanging performance.

Experiment No. 5: The steel contains an excess amount of Ti, so that the specimen has a low λ value and is poor in stretch-flanging performance.

Experiment No. 6: The steel has an insufficient Ti content and a metallographic structure consisting of ferrite and bainite. Therefore, the specimen has a low λ value and is poor in stretch-flanging performance and is also slightly poor in fatigue properties.

Experiment No. 7: The steel has an insufficient Nb content and a metallographic structure consisting of ferrite and bainite. Therefore, the specimen has a low λ value and is poor in stretch-flanging performance and is also slightly poor in fatigue properties.

Experiment No. 9: The steel contains an excess amount of Nb, so that the specimen has a low λ value and is poor in stretch-flanging performance.

Experiment No. 16: The steel has a metallographic structure of polygonal ferrite on account of the excessively low slab heating temperature. Therefore, the specimen is poor in strength and fatigue limit.

Experiment No. 19: Hot rolling with an excessively low finishing temperature permits two phases to exist. Therefore, the specimen has a mixed structure containing a reformed ferrite structure and hence it is poor in fatigue limit and fatigue limit/TS value.

Experiment No. 20: On account of the excessively low cooling rate after hot rolling, the specimen has a structure of polygonal ferrite and is poor in strength, fatigue limit, and fatigue limit/TS value.

Experiment Nos. 24 and 25: On account of the winding temperature exceeding 500° C., the specimen has a polygonal ferrite-rich structure and is poor in fatigue limit and fatigue limit/TS value.

Experiment Nos. 26 and 27: Since the steel does not contain Ti and Nb, the specimen does not have the granular bainitic ferrite structure required in the present invention. Therefore, the specimen is poor in strength, fatigue limit, and fatigue limit/TS value.

Experiment Nos. 29–31: On account of the excessively low cooling rate after hot rolling, the specimen has a structure with a small areal ratio of granular bainitic ferrite structure. Therefore, the specimen has low tensile strength and yield strength and is poor in hole expansion ratio and fatigue limit.

The experimental data in Tables 1 to 3 above are graphically arranged in FIG. 1 to show how each content of C, Ti, and Nb affects (TS×λ) and (fatigue limit/TS) of the steel product obtained in Example. It is apparent from FIG. 1 that for the steel product to have balanced strength, stretch-flanging performance, and fatigue limit, it is necessary that the steel product contain 0.03–0.10% (preferably 0.04–0.08%) C, 0.26–0.50% (preferably 0.28–0.45%) Ti, and 0.15–0.8% (preferably 0.20–0.6%) Nb.

Example 2

Samples of steel slabs having the chemical composition shown in Table 4 were prepared. Each slab was heated at 1250° C. for 30 minutes. The heated slab was hot-rolled into a 2.5-mm sheet in the usual way (at a finishing temperature of 850° C.). The rolled sheet was cooled at an average cooling rate of 50° C./sec. The cooled sheet was wound up at 450° C. The wound sheet was cooled in the air.

The thus obtained hot-rolled steel sheets underwent tensile test and hole expansion test with specimens conforming to JIS No. 5 (in the rolling direction). The specimens were also examined for structure by SEM and TEM observation. The specimens were also examined for cleanliness by observing $C_2$ inclusions under an optical microscope according to JIS G0555.

The hole expansion test consists of punching a hole (10 mm in diameter) in the specimen and forcing a conical punch (60°) into the hole. When the specimen cracks across its thickness, the diameter (d) of the expanded hole is measured. The result is expressed in terms of the ratio (λ) of hole expansion calculated from the following formula.

$$\lambda=[(d-d_0)/10]\times 100(\%),$$

where $d_0$=10 mm

The results are shown in Table 5.

The effect of $C_2$ inclusions on the steel properties is apparent from Table 5. The sample No. 1 is poor in hole expansion because of its high S content which aggravates cleanliness.

TABLE 4

| No. | C (%) | Si (%) | Mn (%) | P (%) | S (ppm) | N (ppm) | Al (%) | Ti (%) |
|---|---|---|---|---|---|---|---|---|
| 1 | 0.05 | 1.5 | 1.5 | 0.011 | 18 | 36 | 0.031 | 0.30 |
| 2 | 0.05 | 1.5 | 1.5 | 0.013 | 10 | 35 | 0.031 | 0.32 |
| 3 | 0.04 | 1.4 | 1.4 | 0.012 | 8 | 41 | 0.032 | 0.31 |

TABLE 5

| No. | Cooling rate (° C./sec) | CT (° C.) | Structure* | Cleanliness (%) | TS (N/mm$^2$) | El (%) | λ (%) |
|---|---|---|---|---|---|---|---|
| 1 | 50 | 450 | 99 | 0.062 | 601 | 22 | 90 |
| 2 | 50 | 450 | 98 | 0.042 | 592 | 23 | 162 |
| 3 | 50 | 450 | 85 | 0.030 | 595 | 23 | 175 |

*Areal ratio (%) of granular bainitic ferrite

What is claimed is:

1. A high-strength hot-rolled steel sheet superior in stretch-flanging properties and fatigue properties, the steel sheet comprising, in mass %, 0.03–0.10% C, less than 2% Si, including 0%, 0.5–2% Mn, less than 0.08% P, including 0%, less than 0.01% S, including 0%, less than 0.01% N, including 0%, 0.01–0.1% Al, and at least one of 0.26–0.5% Ti and 0.25–0.8% Nb, wherein a granular bainitic ferrite structure accounts for more than 80% by area in a sectional metallographic structure of the steel sheet.

2. The steel sheet as defined in claim 1, wherein the granular bainitic ferrite structure accounts for more than 95% (by area) in a sectional metallographic structure of the steel sheet.

3. The steel sheet as defined in claim 1, wherein a cleanliness for $C_2$ inclusions is lower than 0.050%.

4. The steel sheet as defined in claim 1, wherein the steel sheet comprises 0.03–0.08% C.

5. The steel sheet as defined in claim 1, wherein the steel sheet comprises 0.7–1.8% Mn.

6. The steel sheet as defined in claim 1, wherein the steel sheet comprises 0.02–0.08% Al.

7. The steel sheet as defined in claim 1, wherein the steel sheet comprises at least one of 0.28–0.45% Ti and 0.25–0.6% Nb.

8. The steel sheet as defined in claim 1, wherein the steel sheet comprises 0.26–0.5% Ti.

9. The steel sheet as defined in claim 1, wherein the steel sheet comprises 0.28–0.45% Ti.

10. The steel sheet as defined in claim 1, wherein the steel sheet comprises 0.25–0.8% Nb.

11. The steel sheet as defined in claim 1, wherein the steel sheet comprises 0.25–0.6% Nb.

12. A process for producing a high-strength hot-rolled steel sheet superior in stretch-flanging properties and fatigue properties, the process comprising heating a steel at 1150° C. or above, hot-rolling the heated steel at a finishing temperature of 700° C. or above, cooling the rolled steel sheet to 500° C. or below at an average cooling rate of 50° C./sec or above, winding the cooled steel sheet at 500° C. or below, and producing the steel sheet of claim 1.

13. A high-strength hot-rolled steel sheet superior in stretch-flanging properties and fatigue properties, the steel sheet comprising in mass %, 0.01–0.10% C, less than 2% Si, including 0%, 0.5–2% Mn, less than 0.08% P, including 0%, less than 0.01% S, including 0%, less than 0.01% N, including 0%, 0.01–0.1% Al, and at least one of 0.26–0.5% Ti and 0.25–0.8% Nb, wherein a granular bainitic ferrite structure accounts for more than 80% by area in a sectional metallographic structure of the steel sheet.

* * * * *